United States Patent [19]

von Meyer

[11] 4,322,865

[45] Apr. 6, 1982

[54] PNEUMATIC SPONGE MOP

[76] Inventor: Robert F. von Meyer, 219 W. 104th St., New York, N.Y. 10025

[21] Appl. No.: 188,544

[22] Filed: Sep. 18, 1980

[51] Int. Cl.[3] ..... A47L 13/146

[52] U.S. Cl. ..... 15/119 A; 15/244 R

[58] Field of Search ..... 15/116 A, 119 A, 244 R, 15/373

[56] References Cited

U.S. PATENT DOCUMENTS

| | | | |
|---|---|---|---|
| 1,912,543 | 6/1933 | Sendler | 15/119 A |
| 2,733,467 | 2/1956 | Garro | 15/119 A |
| 2,926,373 | 3/1960 | Knapp | 15/119 A |
| 2,961,676 | 11/1960 | Rebernak et al. | 15/119 A |
| 2,996,743 | 8/1961 | Noble | 15/119 A X |
| 3,233,269 | 2/1966 | Scheffold | 15/119 A |
| 3,806,982 | 4/1974 | Park | 15/119 A |
| 4,196,488 | 4/1980 | Barry | 15/119 A |

FOREIGN PATENT DOCUMENTS

| | | | |
|---|---|---|---|
| 501114 | 6/1930 | Fed. Rep. of Germany | 15/244 R |

*Primary Examiner*—Robert L. Bleutge

[57] ABSTRACT

An improved automatic sponge mop with an airtight hollow handle containing a piston which when pulled backwards by the user creates a vacuum in an air chamber. The air chamber has a diaphragm sealing the bottom of it which will move upward in response to the vacuum pulling with it the bottom of a hinged box which folds in upon itself and in so doing compresses an affixed sponge. After the sponge is wrung out the user simply pushes the piston downwards and the process is reversed, opening the sponge to its original cleaning position. The sponge is held in place by dovetail fasteners which allow easy removal by simply pulling sideways on the sponge until it slides off the wringer. Similarly, replacement is accomplished by engaging the tongue and groove connection and pushing the sponge back on. Sliding and accidental removal are inhibited because the sponge is always under tension from the springlike walls of the wringer.

6 Claims, 5 Drawing Figures

PNEUMATIC SPONGE MOP

FIELD OF INVENTION

This invention relates to floor cleaning devices for the home and particularly sponge mops with replaceable mop heads.

DISCUSSION OF PRIOR ART

Heretofore sponge mops have fallen into two catagories: those which were wrung out by squeezing the sponge between two hard surfaces directly by hand, and more recently those which accomplish the same thing by "automatic" or remote control means. The former, while being a notch above getting down on one's hands and knees, was still drudgery. The latter, while being labor saving and a cleaner operation for the user, requires a more complicated device with an elaborate series of mechanical linkages between the user and the sponge. There are, for example, at least four moving parts envolved in actuating mops U.S. Pat. Nos. 2,926,373 and 1,912,543. In addition to being an assembly problem for the manufacturers, the user must exert a great force during the wringing operation because such machines lack mechanical advantage, particularly mop U.S. Pat. No. 2,733,467. And the only way to overcome this problem is by the addition of a lever as with mop U.S. Pat. No. 3,806,982. This, however, aggravates the manufacturer.

Also a nuisance is replacing a worn mop head. This usually envolves unscrewing things or forcing pins through holes with one's fingers. Also the fittings are often poor and tools must be used.

OBJECTS

While clearly belonging to the automatic sponge mop family, my design attempts to overcome some of the afore mentioned disadvantages. By using an airtight tube in place of the conventional handle, air pressure itself can be utilized to transfer a movement from one end of the device to the other end. As in a simple bicycle pump, all that is required is a freely moving piston and you eliminate all the rods, wires, pulleys, shackles, etc. Furthermore the bicycle pump approach eliminates the need for the user to apply a great force to wring the sponge by distributing the short, abrupt movement at the wringer end over the much greater distance of the mop handle.

This phenomenon is the principle used in the hydraulic press where a small piston traveling over a great distance can exert a tremendous force in a large piston.

Accordingly some of the objects of my mop are: the reduction of the number of moving parts making it better suited for mass production, and in general, a more efficient machine; less effort in actuating the mop; and greater facility in mop head replacement.

Further objects and advantages of my invention will become apparent from a consideration of the drawings and ensuing description thereof.

Figure 1:
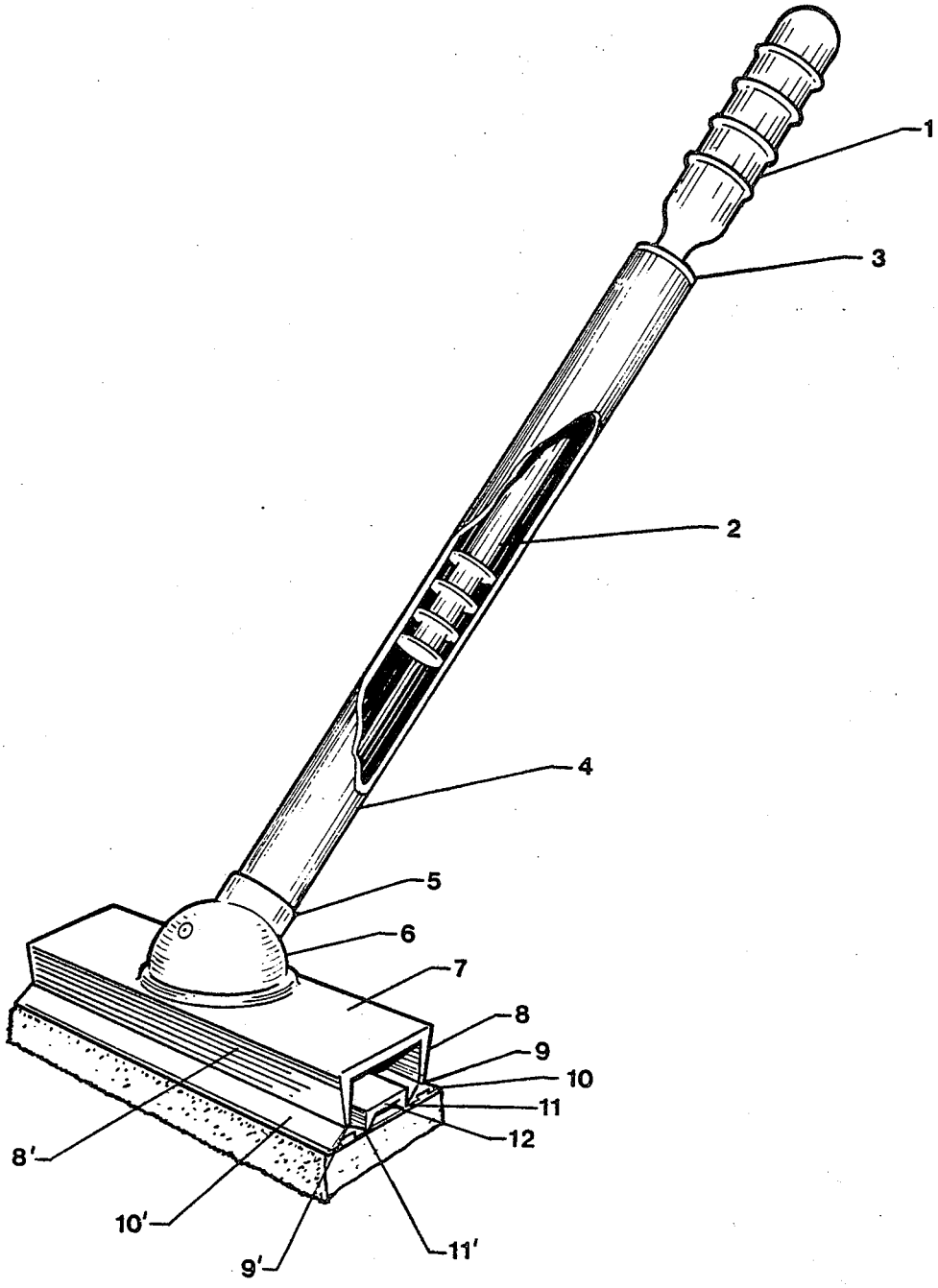
FIG. 1 is a perspective view of the entire mop with a partial cutaway of the handle exposing the piston.
Figure 4:
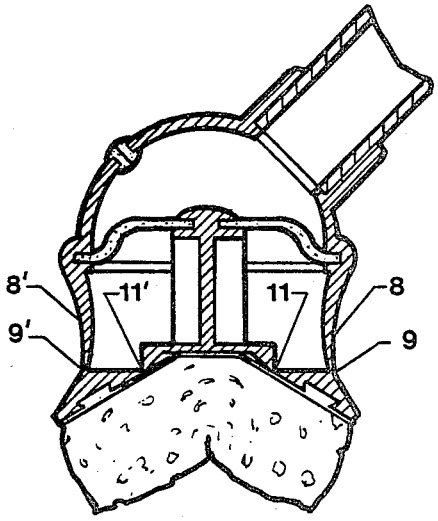
Figure 3:
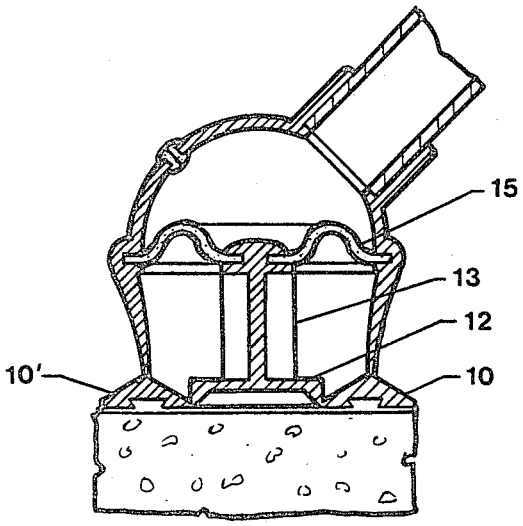
Figure 5:
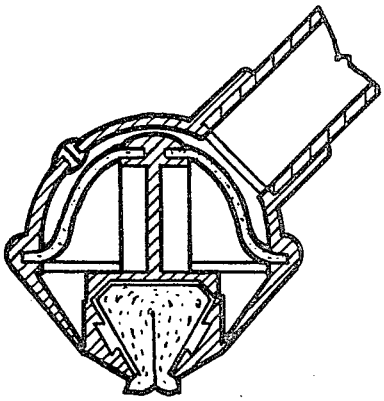
Figure 2:
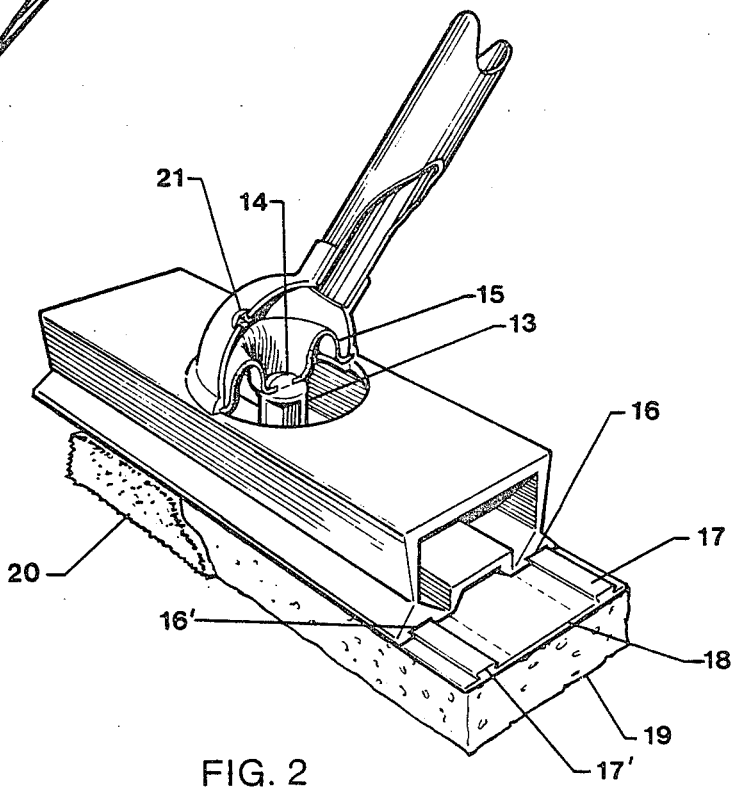
FIG. 2 is a cutaway perspective of the wringer and air chamber exposing the diaphragm. Also shown is the sponge and how it fastens to the wringer.

FIGS. 3, 4, & 5 are cross sectional views of the mop being compressed along with the action of the diaphragm.

DESCRIPTION

Not unlike most, the improved mop resembles an inverted 'T' with the handle as the stem and the wringer as the crossbar. The elongated handle (4) is hollow and encloses a piston (2) in such a way as to be airtight, but still allowing for the free movement of the piston which is held on center and contained by guide ring (3). Fastened or bonded to the handle by means of a collar (5) is an air chamber (6) with a check valve (21). Hermetically sealing the bottom of the air chamber is a diaphragm (15) which is flexible and will move up and down in response to a change in air pressure inside the air chamber. Pinned to the diaphragm by a button (14) and shank (13) is the spine (12) of two presser plates (10) and (10') which are attached to it by elongated hinges (11) and (11'). Another pair of hinges (9) and (9') connect the presser plates to flexible walls (8) and (8') which are held firmly at the top by a rigid roof plate (7). As the roof spans the walls and supports the air chamber, the structure of the mop is now complete.

The mop head or sponge (19) is elongate and rectangular in section with an uninterrupted abrasive cleaning pad (20) bonded to it. Also bonded to the sponge is a backing (18) from which runners (17) and (17') mate with corresponding slots (16) and (16') of the presser plates.

OPERATION

For mopping action the presser plates (10) and (10') are in an extended position as shown in FIG. 3 allowing maximum contact with the floor by the attached sponge (19). When the user wishes to wring the sponge the handle (4) is held steady and the piston (2) is pulled rearwardly by its grip (1). This creates a relative vacuum in the hollow of the handle and also in the air chamber (6) which is confined to it. This vacuum causes the atmospheric pressure outside the mop to bear upon the diaphragm (15) forcing it to collapse upwards. When the diaphragm moves up it pulls the spine (12) of the wringer by means of a connecting shank (13). The spine in turn pulls at the presser plates (10) and (10') through hinged connections (11) and (11') so that they rotate inward around another set of hinges (9) and (9') attached to the walls (8) and (8') until they reach the vertical position shown in FIG. 5. In order to achieve this the walls must flex outward as shown in FIG. 4. This flexibility permits rotation of the presser plates which can only be accomplished if their outer hinged connections (9) and (9') are allowed to move laterally while their inner hinged connections (11) and (11') move vertically.

Concomitantly the sponge, being firmly affixed to the presser plates, is being bent and folded along its long axis as shown in FIG. 4 until it reaches the position in FIG. 5 wherein it is completely compressed and the water has been squeezed out. This compression is further facilitated by the action of the walls which when forced apart will exert a lateral force back inward in order to resume their normal position.

To get the mop back into its working position again the user need only push the piston downwards and the entire process is reversed; the diaphragm, shank, and spine move downwards forcing the presser plates to rotate back open and the sponge to unfold.

In order to replace a worn sponge the user must disengage the dovetail fasteners which hold the sponge to the presser plates. This is done by simply grasping the sponge and pulling it laterally off the slotted presser plates. A new sponge is then inserted by nestling the runners (17) and (17') into keyways or slots (16) and (16') and pushing the sponge until it is again centered on the wringer. Accidental removal is inhibited because in its mopping position, FIG. 3, the sponge and its backing are always slightly under tension. That is, the sponge is being pulled or stretched from front to back by the wringer whose walls (8) and (8') are always slightly flexed in this position. This causes a friction fit or tightness in the fasteners impeding lateral movement.

Needless to say the sponge should be moistened before use. But in the event of actuation of the mop with a bone dry sponge which would be inflexible and put undue strain on the fittings of the mop, a rubber check valve (21) may be included in the air chamber.

While the above description contains many specificities, these should not be construed as limitations on the scope of the invention, but rather as an exemplification of one preferred embodiment thereof. Many other variations are possible, for example: in the air chamber another piston could be used instead on a diaphragm and the results would be the same; instead of the air chamber with its diaphragm and shank, end walls could be added forming a closed box of the wringer, and the results would be the same; for creating a vacuum, a telescoping handle could be substituted for a draw piston and the results would be the same; instead of air, a liquid could confined to the hollows of the mop, as with the hydraulic press mentioned above, and the results would be the same. Accordingly, the scope of the invention should be determined not by the embodiment illustrated, but by the appended claims and their legal equivalents.

What I claim is:

1. A pneumatic sponge mop comprising an airtight tubular handle terminating in an air chamber with a means of creating a vacuum therein whereupon a movable bottom in the air chamber will oscillate upward in response to the vacuum, an elongate boxlike wringer with a rigid top, flexible walls, and an articulated bottom capable of collapsing upward when pulled by a linkage to the movable bottom of the air chamber, and in so doing axially folding and compressing an elongate mop head attached to it by quick release fasteners.

2. A pneumatic sponge mop in accordance with claim 1 wherein the means for creating a vacuum is a freely moving piston with a handle grip for manual actuation, or a telescoping handle.

3. A pneumatic sponge mop in accordance with claim 1 wherein said articulated bottom consists of two presser plates whose inner edges are hingedly connected to a spine and whose outer are hingedly connected to said flexible walls.

4. A pneumatic sponge mop in accordance with claim 3 wherein said spine, when pulled upward, will rotate said presser plates from a horizontal position into a vertical position, and in so doing force said flexible walls apart at the bottom.

5. A pneumatic sponge mop in accordance with claim 1 wherein said movable bottom of said air chamber is a piston, a diaphragm, or a bellows.

6. A pneumatic sponge mop in accordance with claim 1 wherein the hollows of said handle and air chamber are filled with a liquid creating thereby a hydraulic sponge mop.

* * * * *